US008829803B2

(12) United States Patent
Keong et al.

(10) Patent No.: US 8,829,803 B2
(45) Date of Patent: Sep. 9, 2014

(54) POWER SUPPLY SYSTEM

(75) Inventors: Khor Joo Keong, Shenzhen (CN); Wen-Kao Feng, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 88 days.

(21) Appl. No.: 13/528,925

(22) Filed: Jun. 21, 2012

(65) Prior Publication Data

US 2013/0043804 A1 Feb. 21, 2013

(30) Foreign Application Priority Data

Aug. 19, 2011 (CN) ..... 2011 1 0239725

(51) Int. Cl.
*H05B 41/16* (2006.01)
*H05B 33/08* (2006.01)
*H05B 37/02* (2006.01)

(52) U.S. Cl.
CPC ..... *H05B 33/0806* (2013.01); *H05B 37/0245* (2013.01); *H05B 37/0209* (2013.01)
USPC ..... 315/246; 315/224; 315/291

(58) Field of Classification Search
USPC ..... 315/209 R, 219, 224–226, 246, 283, 291
See application file for complete search history.

(56) References Cited

U.S. PATENT DOCUMENTS

| | | | | |
|---|---|---|---|---|
| 2004/0170036 | A1* | 9/2004 | Iwahori | 363/89 |
| 2005/0035719 | A1* | 2/2005 | Dellian et al. | 315/244 |
| 2006/0006819 | A1* | 1/2006 | Franck et al. | 315/291 |
| 2007/0138970 | A1* | 6/2007 | Hendrix | 315/209 R |
| 2010/0109573 | A1* | 5/2010 | Ichikawa et al. | 315/307 |

* cited by examiner

*Primary Examiner* — Tung X Le
(74) *Attorney, Agent, or Firm* — Novak Druce Connolly Bove + Quigg LLP

(57) ABSTRACT

A power supply system includes an illumination circuit for receiving an AC voltage and a control circuit for receiving a DC voltage. The illumination circuit includes a first switch unit and at least one light emitting unit. The control circuit includes a first winding unit, a second switch unit, and a second winding unit. The second winding unit provides the DC voltage to the first winding unit by the second switch unit. The first winding unit provides the AC voltage to the light emitting unit by the first switch unit. The light emitting unit emits light when receives the AC voltage.

13 Claims, 3 Drawing Sheets

POWER SUPPLY SYSTEM

BACKGROUND

1. Technical Field

The present disclosure relates to a power supply system for saving power.

2. Description of Related Art

A data center is a facility used to house computer systems and associated components, such as telecommunications and storage systems. Many data centers include redundant or backup power supplies, redundant data communications connections, environmental controls (e.g., air conditioning, fire suppression, illumination system) and security devices. Programmable Logic Control (PLC) systems may be used to monitor and control the illumination system in the data center. However, when a user is away from the data center and forgets to shut down the illumination system, a waste of power may occur.

Therefore there is a need for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
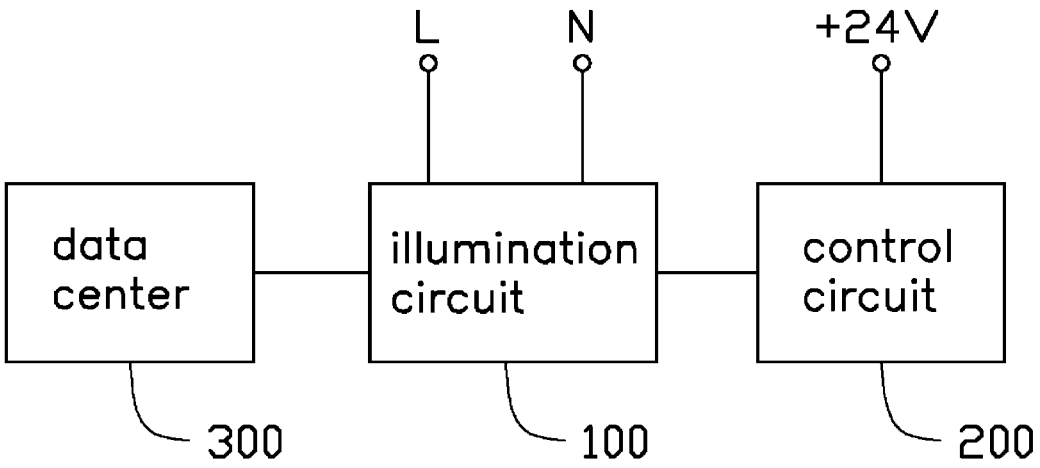
FIG. 1 is a block diagram of an embodiment of a power supply system, the power supply system including an illumination circuit and a control circuit.

FIG. 1, is a power supply system in accordance with an embodiment. The power supply system supplies power to a data center 300. The power supply system includes an illumination circuit 100 and a control circuit 200. The illumination circuit 100 receives a +220V AC Voltage. The control circuit 200 receives a +24V DC voltage. The +220V AC Voltage includes a live wire output terminal L and a neutral wire output terminal N.

Figure 2:
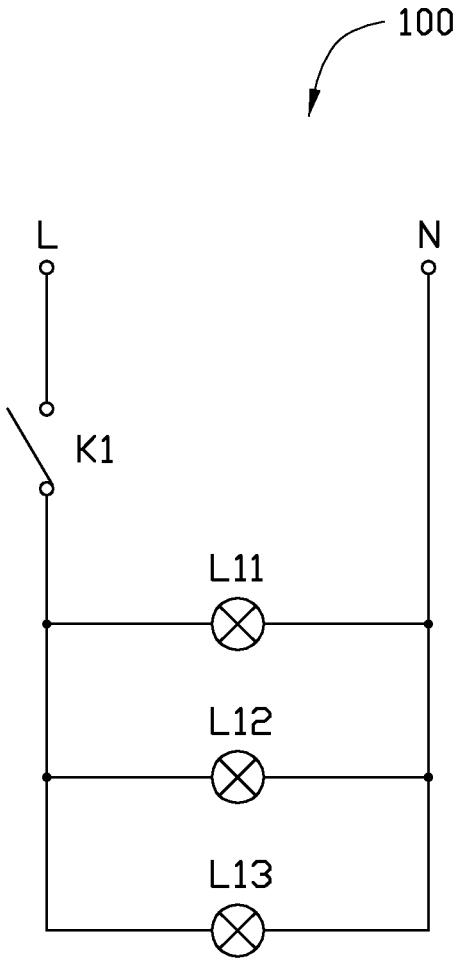
FIG. 2 is a circuit diagram of the illumination circuit of FIG. 1.

FIG. 2, illustrates the illumination circuit 100. The illumination circuit 100 includes a first switch unit K1 and a plurality of lights L11, L12, L13, etc. The plurality of lights L11, L12, L13, etc. are connected in parallel. First terminals of the plurality of lights L11, L12, L13, etc. are electrically connected to the live wire output terminal L of the +220V AC Voltage via the first switch unit K1. Second terminals of the plurality of lights L11, L12, L13, etc. are electrically connected to the neutral wire output terminal N of the +220V AC Voltage. In one embodiment, the first switch unit K1 is a normally open contact.

Figure 3:
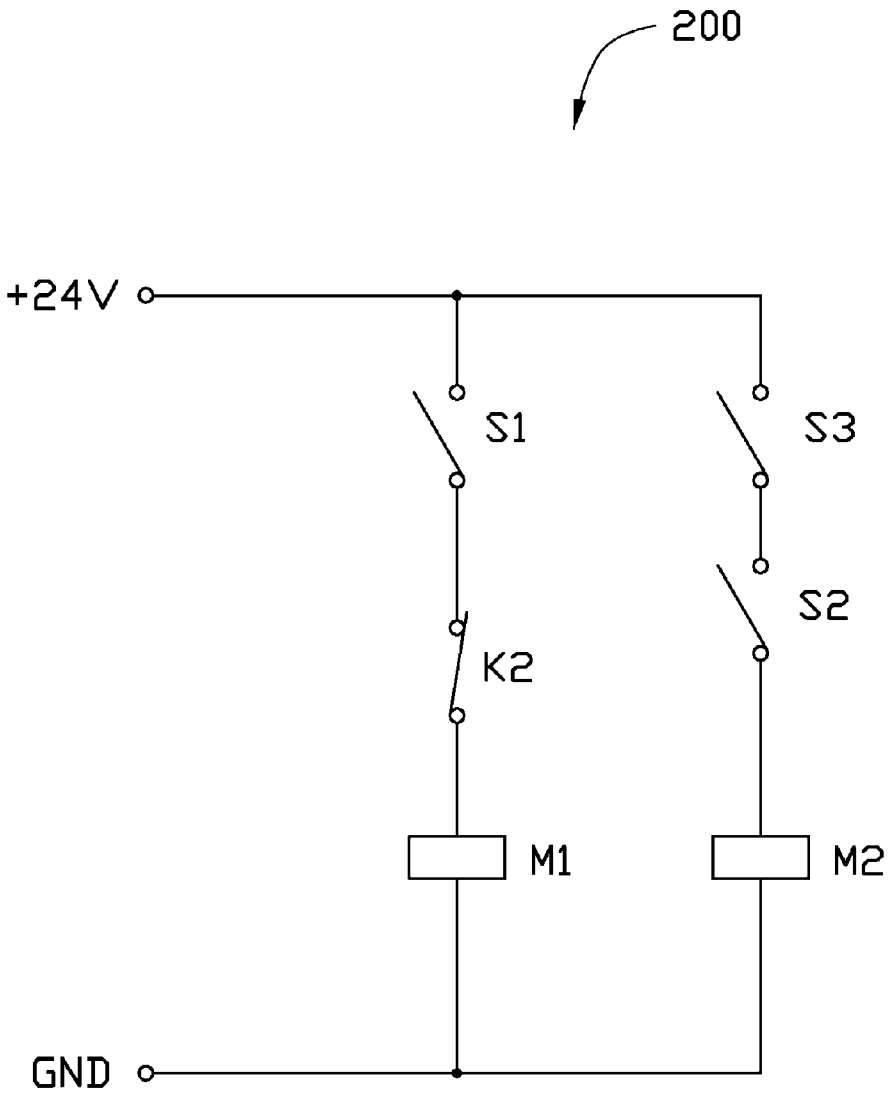
FIG. 3 is a circuit diagram of the control circuit of FIG. 1.

FIG. 3, illustrates the control circuit 200. The control circuit 200 includes a first winding unit M1, a second switch unit K2, a first switch S1, a second winding unit M2, a second switch S2 and a third switch S3. A first terminal of the first winding unit M1 is electrically connected to receive the +24V DC voltage via the second switch unit K2 and the first switch S1 are electrically connected in series. A second terminal of the first winding unit M1 is grounded. A first terminal of the second winding unit M2 is electrically connected to receive the +24V DC voltage via the second switch S2 and the third switch S3 are electrically connected in series. A second terminal of the second winding unit M2 is grounded. In one embodiment, the second switch unit K2 is a normally closed contact. The first switch unit K1 is controlled by the first winding unit M1 when the first winding unit M1 is powered on. The second switch unit K2 is controlled by the second winding unit M2 when the second winding unit M2 is powered on.

In a working state, the second switch S2 and the third switch S3 are connected to an entrance of the data center 300. The second switch S2 and the third switch S3 are switched on when the entrance of the data center 300 is shut down. The second switch S2 and the third switch S3 are switched off when the entrance of the data center 300 is opened. When a user enters into the data center 300, the entrance of the data center 300 is opened. The second switch S2 and the third switch S3 are switched off. The second winding unit M2 cannot receive the +24V DC voltage and is powered off. The second switch unit K2 keeps a normally closed state. The first switch S1 is then switched on. The first winding unit M1 receives the +24V DC voltage and is powered on. The first switch unit K1 changes from a normally open state to a normally closed state. The plurality of lights L11, L12, L13, etc. receives the +220V AC Voltage. The plurality of lights L11~L13 are powered on and emit light.

When the user is away from the data center 300, the entrance of the data center 300 is shut down. The second switch S2 and the third switch S3 are switched on. The second winding unit M2 receives the +24V DC voltage and is powered on. The second switch unit K2 changes from the normally closed state to a normally open state. The first winding unit M1 cannot receive the +24V DC voltage and is powered off. The first switch unit K1 changes from the normally closed state to the normally open state. The plurality of lights L11~L13 cannot receive the +220V AC Voltage. The plurality of lights L11, L12, L13, etc. are powered off and do not emit light.

Even though numerous characteristics and advantages of the present disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A power supply system comprising:

an illumination circuit adapted to receive an AC voltage; the illumination circuit comprising a first switch unit and at least one light emitting unit; and a control circuit adapted to receive a DC voltage; the control circuit comprising a first winding unit, a second switch unit, and a second winding unit; wherein the second winding unit is adapted to provide the DC voltage to the first winding unit by the second switch unit; the first winding unit is adapted to provide the AC voltage to the at least one light emitting unit by the first switch unit; and the at least one light emitting unit is adapted to emit light when receives the AC voltage;

wherein the control circuit further comprises a first switch and a second switch; a first terminal of the first winding unit is electrically connected to receive the DC voltage via the second switch unit and the first switch electrically connected in series; a second terminal of the first winding unit is grounded; a first terminal of the second winding unit is electrically connected to receive the DC voltage via the second switch; and a second terminal of the second winding unit is grounded.

2. The power supply system of claim 1, wherein the AC Voltage comprises a live wire output terminal and a neutral wire output terminal; a first terminal of the at least one light emitting unit is electrically connected to the live wire output terminal via the first switch unit; and a second terminal of the at least one light emitting unit is electrically connected to the neutral wire output terminal.

3. The power supply system of claim 2, wherein the first switch unit is a normally open contact; and the first switch unit is controlled by the first winding unit when the first winding unit is powered on.

4. The power supply system of claim 3, wherein the second switch unit is a normally closed contact; and the second switch unit is controlled by the second winding unit when the second winding unit is powered on.

5. The power supply system of claim 4, wherein the DC voltage is +24V.

6. The power supply system of claim 5, wherein when the second switch is switched off, the second winding unit is powered off; the second switch unit is adapted to keep a normally closed state; the first switch is switched on; the first winding unit is powered on; the first switch unit is adapted to change from a normally open state to a normally closed state; the at least one light emitting unit is powered on; and the at least one light emitting unit is adapted to emit light.

7. The power supply system of claim 6, wherein when the second switch is switched on, the second winding unit is powered on; the second switch unit is adapted to change from the normally closed state to a normally open state; the first winding unit is powered off; the first switch unit is adapted to change from the normally closed state to the normally open state; the at least one light emitting unit is powered off; and the at lest one light emitting unit does not emit light.

8. A power supply system comprising:

an illumination circuit adapted to receive an AC voltage; the illumination circuit comprising a first switch unit and at least one light emitting unit; and a control circuit adapted to receive a DC voltage; the control circuit comprising a first winding unit, a second switch unit, a first switch, a second winding unit, and a second switch; a first terminal of the first winding unit is electrically connected to receive the DC voltage via the second switch unit and the first switch electrically connected in series; a second terminal of the first winding unit is grounded; a first terminal of the second winding unit is electrically connected to receive the DC voltage via the second switch; and a second terminal of the second winding unit is grounded; wherein the AC Voltage comprises a live wire output terminal and a neutral wire output terminal; a first terminal of the at least one light emitting unit is electrically connected to the live wire output terminal via the first switch unit; and a second terminal of the at least one light emitting unit is electrically connected to the neutral wire output terminal.

9. The power supply system of claim 8, wherein the first switch unit is a normally open contact; and the first switch unit is controlled by the first winding unit when the first winding unit is powered on.

10. The power supply system of claim 9, wherein the second switch unit is a normally closed contact; and the second switch unit is controlled by the second winding unit when the second winding unit is powered on.

11. The power supply system of claim 10, wherein the DC voltage is +24V.

12. The power supply system of claim 11, wherein when the second switch is switched off, the second winding unit is powered off; the second switch unit is adapted to keep a normally closed state; the first switch is switched on; the first winding unit is powered on; the first switch unit is adapted to change from a normally open state to a normally closed state; the at least one light emitting unit is powered on; and the least one light emitting unit is adapted to emit light.

13. The power supply system of claim 12, wherein when the second switch is switched on, the second winding unit is powered on; the second switch unit is adapted to change from the normally closed state to a normally open state; the first winding unit is powered off; the first switch unit is adapted to change from the normally closed state to the normally open state; the at least one light emitting unit is powered off; and the at least one light emitting unit does not emit light.

* * * * *